US008968977B2

(12) United States Patent
Faucher et al.

(10) Patent No.: US 8,968,977 B2
(45) Date of Patent: Mar. 3, 2015

(54) CONTINUOUS PRODUCTION OF TONER

(71) Applicant: Xerox Corporation, Norwalk, CT (US)

(72) Inventors: Santiago Faucher, Oakville (CA); Kimberly D Nosella, Mississauga (CA); Melanie Davis, Hamilton (CA); Edward Graham Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 91 days.

(21) Appl. No.: 13/717,104

(22) Filed: Dec. 17, 2012

(65) Prior Publication Data

US 2014/0170548 A1 Jun. 19, 2014

(51) Int. Cl.

| | |
|---|---|
| ***G03G 9/08*** | (2006.01) |
| ***G03G 9/087*** | (2006.01) |
| ***G03G 9/093*** | (2006.01) |

(52) U.S. Cl.

CPC ..... *G03G 9/0804* (2013.01); *G03G 9/0827* (2013.01); *G03G 9/08782* (2013.01); *G03G 9/09392* (2013.01)

USPC ..... 430/137.14

(58) Field of Classification Search

CPC G03G 9/0804; G03G 9/08755; G03G 9/0806

USPC ..... 430/137.14

See application file for complete search history.

(56) References Cited

U.S. PATENT DOCUMENTS

2007/0082287 A1* 4/2007 Wolfe et al. ..... 430/137.14
2011/0207044 A1* 8/2011 Zwartz et al. ..... 430/105

* cited by examiner

*Primary Examiner* — Hoa V Le
(74) *Attorney, Agent, or Firm* — MDIP LLC

(57) ABSTRACT

Continuous and semi-continuous emulsion aggregation processes for the production of toner particles are presented.

18 Claims, 1 Drawing Sheet

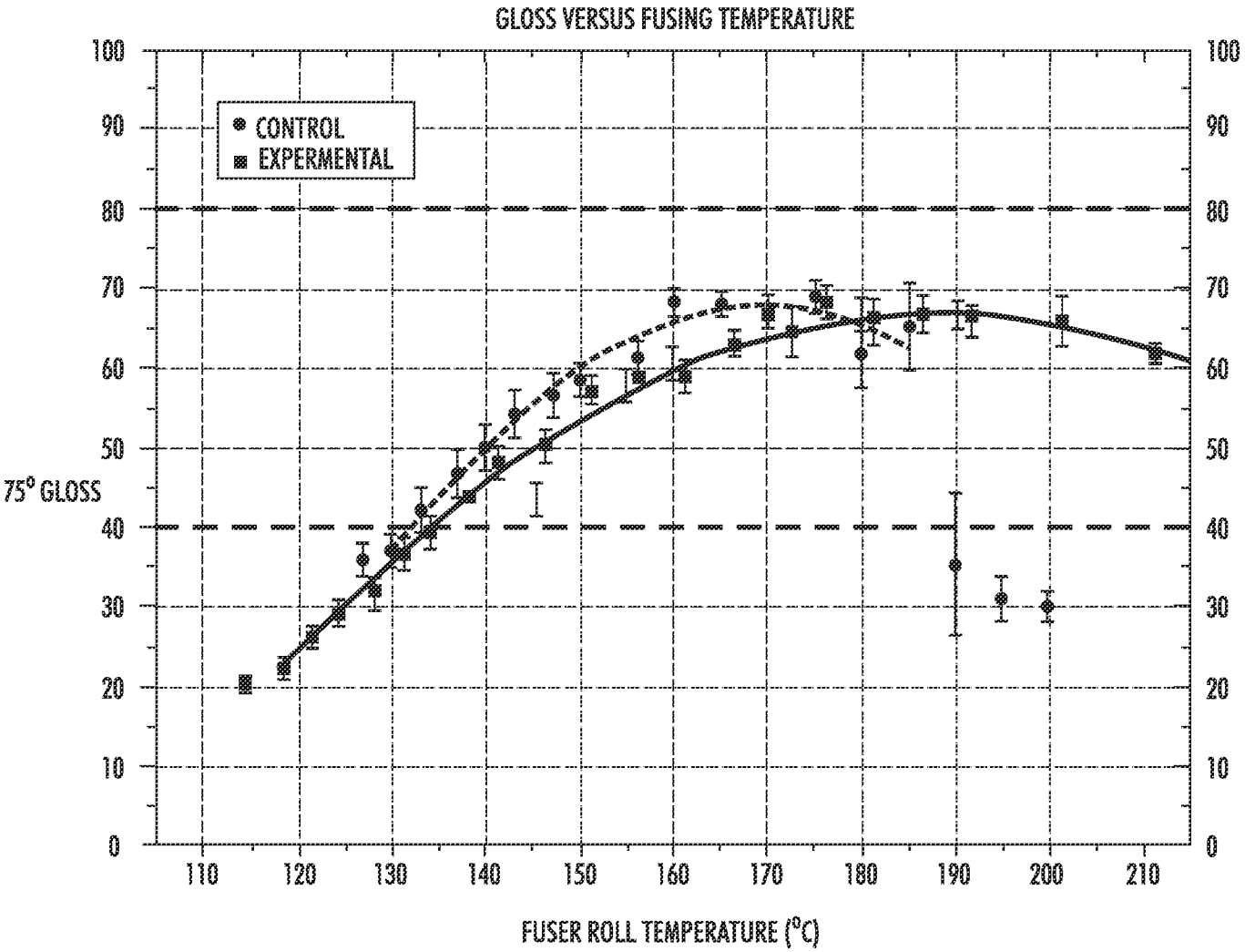
GLOSS VERSUS FUSING TEMPERATURE
CONTROL
EXPERIMENTAL
75° GLOSS
FUSER ROLL TEMPERATURE (°C)
0
10
20
30
40
50
60
70
80
90
100
110
120
130
140
150
160
170
180
190
200
210

CONTINUOUS PRODUCTION OF TONER

BACKGROUND

The present disclosure relates to emulsion aggregation (EA) processes via a series of controllable contiguous or non-contiguous tank reactors for producing toner particles of desirable properties.

Processes for forming toner compositions for use with electrophotographic print or copy devices have been previously disclosed. For example, methods of preparing an emulsion aggregation (EA)-type toner are known and toners may be formed by aggregating a colorant with a latex polymer formed by batch emulsion polymerization. For example, U.S. Pat. No. 5,853,943, the disclosure of which is hereby incorporated by reference in entirety, is directed to a semi-continuous EA process for preparing a latex by first forming a seed polymer. Other examples of EA processes for the preparation of toners are illustrated in U.S. Pat. Nos. 7,785,763, 7,749,673, 7,695,884, 7,615,328, 7,429,443, 7,329,476, 6,830,860, 6,803,166 and 6,764,802, the disclosure of each of which hereby is incorporated by reference in entirety.

Batch processes for producing resins may be subjected to bulk polycondensation polymerization in a batch reactor at an elevated temperature. The time required for the polycondensation reaction can be long, due to heat transfer of the bulk material, high viscosity and limitations on mass transfer. The resulting resin then is cooled, crushed and milled prior to being dissolved in a solvent. The dissolved resin can be subjected, for example, to a phase inversion process where the resin is dispersed in an aqueous phase to prepare latexes. The solvent then is removed from the aqueous phase by a distillation method.

The use of solvents in such process causes environmental concerns. For example, if the solvent level is not low enough (<50 ppm), extensive waste water treatment and solvent remediation may be required.

In addition, where a batch process is utilized for aggregation and/or coalescence process, because the individual batch process involves the handling of bulk amounts of material, each process may take many hours to complete before moving to the next process in the formation of the toner particles. Batch-to-batch consistency can be difficult to achieve because of the number of and quality of reagents, the reactions and the conditions.

Wax often is included in toner, for example, to assist in the transfer of materials during the image-forming process. However, the transfer of materials depends, in part, on charge at the toner surface. Wax can have a negative impact on toner charge when present at the toner surface. Hence, toner with reduced wax content is beneficial.

Gloss can be controlled by fuser temperature, a variable that may change with run rate as well as environmental and use conditions. To overcome those variables, flat and/or wide gloss vs. temperature curves are preferred since such data and properties indicate variations of fuser roll or belt temperature on print image quality are minimized Such material is referred to as having wide fusing latitude.

SUMMARY

The present disclosure provides for controlled semi-continuous or continuous emulsion aggregation processes to produce toners with desirable properties, such as, an enhanced fusing property, such as, wider fusing latitude, which can be obtained with lower wax amounts, as compared to similar toner containing higher levels of wax and/or made by batch processes alone.

In embodiments, a process for the production of toner particles by emulsion aggregation is disclosed, including continuously or semi-continuously feeding latex materials in a reactor system containing at least one reactor for facilitating an aggregation process and at least one reactor for facilitating temperature ramp-up and a coalescence process, where the latex materials include at least one latex resin, an optional pigment, a wax, an optional shell latex resin, an optional flocculent or combinations thereof, aggregating the latex materials; ramping up the temperature of the latex materials; and coalescing the materials to produce toner particles. The process produces toner particles that exhibit a flatter and/or wider gloss versus temperature curve profile as compared to toner particles made by a batch method or toner particles containing conventional amounts of wax particles, that is, the resulting toner particles exhibit an equivalent or greater (wider) fusing latitude using about 25% less wax as compared to toner particles containing twice as much wax and made by a batch method.

BRIEF DESCRIPTION OF THE DRAWING

Various embodiments of the present disclosure are described hereinbelow with reference to the FIGURE.

FIG. 1 shows a plot of gloss versus fusing temperature using a Xerox 700 photocopier with a fuser operating at 220 mm/s. The images were presented on standard 24# paper with a TMA of 1 mg/cm$^2$. The control toner was made by a batch process and the experimental toner was made by a continuous process of interest.

DETAILED DESCRIPTION

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating" and "matching," or grammatical variations thereof, have generally acceptable definitions or at the least, are understood to have the same meaning as, "about."

As used herein, "flat", including grammatical variations thereof, means a line having a curvature approaching that of a horizontal plane, containing a low slope or tilt as compared to another line having a curvature approaching that of a circle, ellipse or parabola, containing a greater slope or tilt. In a Cartesian coordinate plot, a flat curve is one which parallels, substantially or in fact, the X axis. By substantially is meant about 20° or less from parallel. As known in the art, a parabolic curve can be described by a quadratic equation, $y=ax^2+bx+c$. A flat curve is one where the absolute value of the, "a," coefficient approaches zero, as it is known that when a=0, the curve is a straight line. Hence, when comparing curves, such as, gloss v. fusing temperature curves of two toners, the quadratic equations of the two curves are derived and if the absolute value of the, "a," coefficient of the first curve is less or smaller in value of that of the second curve, then the first curve is flatter than the second curve.

As used herein, "wide," including grammatical variations thereof, means a first curved line (i.e., not straight) having a width extent from point to point of greater or more than average as compared to another second curved line. The wider, flatter curve has a larger variance than the narrower, sharper curve. Hence, a wider curve can be defined as one which is flatter, as determined as described above. The width of a curve also can be calculated by moving the vertex of the curve over the y axis and summing the units spanning the two x intercepts. A curve with a sum greater than that of a second curve is wider than the second curve. If that sum is the same, than the apex of the curves, represented by the absolute maximum value on the y axis can be determinative of which curve is flatter, that is, the curve with the lower absolute value on the y axis.

As used herein, "a curve profile," means a line graph representing the extent to which an object exhibits various tested characteristics that deviates from straightness in a smooth, continuous fashion.

As used herein, the phrase, "an enhanced fusing property," refers to a known toner fusing property, such as, hot offset, cold offset, fusing latitude and so on, as known in the art, which is improved over a toner containing the same reagents but made exclusively by a batch method. An enhanced fusing property also describes a toner that has comparable, that is, at least about the same, performance as a toner made by a batch method, but with an alteration in a reagent, reagent amount or both. Hence, a toner containing less wax than found normally in a conventional toner, but with about the same or improved fusing performance is a toner with an enhanced fusing property.

The present disclosure provides for a process for semi-continuous and continuous production of EA toner particles with a space time yield (STY) of greater than about 50 g/L/hr, greater than about 75 g/L/hr, greater than about 150 g/L/hr, or more. As used herein, a space time yield represents, in embodiments, the mass of a product P formed, per total reactor volume used, per total residence time in the total reactor volume. The following formula is applied to determine the space time yield, $\Sigma_p = m_p/Vt$; where $m_p$ is the mass of the dry toner (product), V is the total reactor volume and t is total reactor residence time. The STY can be at least about a 5-fold improvement over the current batch EA process, which has a space time yield of about 9 g/L/hr, at least about a 10-fold improvement, at least about a 15-fold improvement. The proposed process, due to compact scale, requires lower workforce and capital expenditure, reducing the overall cost of producing EA toner particles.

The processes of the present disclosure rely on a series of tank reactors for the various steps of an EA process. Each reactor is set to operate under a specific set of conditions to attain the desired effect on particle size, particle size distribution, circularity and other such factors pertinent to achieving toner particles. In addition, recent advances in high throughput EA have been combined to increase the speed of the EA process such as, for example, the use of buffers in lieu of bases.

In general, in accordance with the present disclosure, reactor systems are provided, which include a plurality of vessels, where each vessel is equipped with stirrers, impellers and temperature controls. The separate vessels, which function as separate reactors continuously or semi-continuously can use separate transfer pumps in fluid communication with said vessels, make from about 10 g/min to about 400 g/min or more of coalesced final toner slurry, with residence times of about 5 min, 10 min and so on. Hence, particles can be produced at a rate of at least about 10 g/min, at least about 20 g/min, at least about 30 g/min or more. In embodiments, a reactor system produced about 40 g/min of toner slurry under about a 5 min or about a 10 min residence time per reactor. The sizes of the reactors may be selected to reduce the amount of raw materials needed during the reactions while being sufficiently large to permit sampling. Larger reactors may be used with suitable adjustment of the fluid mixing profile and temperature ranges to obtain desired particle growth and particle size distribution.

In embodiments, aggregation steps are completed in a batch process in a first vessel (i.e., homogenization of at least one latex with optional reagents, such as, surfactant, wax, pigment, flocculent, subsequent shell latex addition, base addition and chelator addition to freeze the particles), which resulting slurry is transferred to a second vessel for continuous temperature ramp and coalescence via a transfer pump in fluid communication between the first and second vessels or by gravity.

Aggregation can occur with the slurry temperature from about 30° C. to about 45° C., from about 32° C. to about 42° C., from about 34° C. to about 40° C., although a temperature outside of those ranges can be used as a design choice.

In embodiments, the homogenized slurry is transferred to a second vessel via pump in fluid communication with said first vessel, to which a shell latex is added to the second vessel to form a shell and then with a base and a chelator to freeze growth of the particles in the slurry. The pH of the slurry can be increased to from about 7 to about 8.5, from about 7.2 to about 8.3, from about 7.4 to about 8.1, although a pH outside of those ranges can be used as a design choice.

In embodiments, the continuous process includes adding the shell latex resin in a first separate contiguous reactor section and heating said section to from about 35° C. to about 45° C., from about 37° C. to about 43° C., from about 39° C. to about 41° C.; adding base or buffer and a chelator in a second separate contiguous reactor section and heating said section from about 40° C. to about 50° C., from about 42° C. to about 48° C., from about 44° C. to about 46° C. to freeze aggregation; and adding one or more buffers in a third separate contiguous reactor section and heating said section to about 85° C. for coalescence to occur, where the temperature of each of the reactor sections is modulated by externally applied cooling or heating.

In embodiments, the slurry then is transferred to one or more contiguous vessels in series via a pump in fluid communication with the second vessel and a proximal end of the one or more contiguous vessels, where continuous ramp up and coalescence proceeds. The temperature at which coalescence occurs can be from about 80° C. to about 90° C., from about 82° C. to about 89° C., from about 84° C. to about 88° C., although a temperature outside of those ranges can be used as a design choice. The ramp-up and coalescence can occur in from about 5 min to about 15 min, although times outside of that range can be used.

In embodiments, latex materials are continuously fed as a latex slurry, where aggregating, ramping and coalescing are obtained in a reactor system which contains reactor vessels that are sequentially assembled in series. For example, the reactor system may contain at least one reactor for homogenization of said latex materials, at least one reactor for facilitating an aggregation process, and at least one reactor for facilitating temperature ramp-up and coalescence processes, where homogenizing the latex materials can occur in one or more sections of the system; where aggregating the latex materials occurs in one or more sections of the system which can be separate from the homogenizing sections; where ramping the temperature of the latex materials to higher temperatures occurs in one or more sections of the system which are separate from the homogenizing and aggregating sections; and where coalescing the materials to produce toner particles occurs in one or more sections which are separate from the homogenizing, aggregating and ramp sections or where ramp and coalescence can occur in the same sections, which are separate from the homogenizing and aggregating sections.

In embodiments, the continuous process includes adding the shell latex resin in a first separate contiguous reactor section and heating said section; adding a buffer and/or a chelator in a second separate contiguous reactor section and heating said section to freeze particle growth; and adding one or more buffers in a third separate contiguous reactor section and heating said section for coalescence, where the temperature of each of the reactor sections is modulated by externally applied cooling or heating.

In embodiments, separate reactors may be immersed in a temperature control bath to control the temperature of the toner slurry inside the reactors. For example, double-walled reactors or resistance heating may also be used for heating and cooling to achieve the desired temperature. Slurry within the reactors may be pumped in and out of the reactors using, for example, multi-channel peristaltic pumps. For example, the shell latex may be pumped into a separate reactor using a peristaltic pump, whereas the base, the chelating agent and buffer may pumped into the respective reactors as necessary to achieve the various EA process steps.

Particle size traces obtained after the aggregation step can reach steady state after only about 2-5 min, such as, less than about 5 min, less than about 10 min and so on. Toner product obtained after ramp up and coalescence can be quenched by known methods, such as, stirring the product in a beaker filled with distilled water (DIW) ice cubes.

In semi-continuous embodiments, particle aggregation in a latex slurry is frozen in a non-contiguous vessel before application of ramp and coalescence steps, where the latter steps are continuous.

In continuous embodiments, all steps are conducted in a series of contiguous vessels (i.e., sections), where homogenization, shell addition, freezing of particles and coalescence process are carried out in separate sections and where the raw materials may be aggregated and coalesced continuously in, for example, less than about 20 min, less than about 30 min, less than about 35 minutes or more residence time to produce toner particles with a $D_{50}$ of about 4, of about 5, of about 6, GSDv of about 1.2, of about 1.3, of about 1.4, GSDn of about 1.2, of about 1.3, of about 1.4, and circularity of at least about 0.95, at least about 0.96, at least about 0.97. In embodiments, circularity may be measured using an FPIA-2100 or FPIA 3000 device manufactured by Sysmex. In embodiments, the particles have a circularity from about 0.950 to about 0.985, from about 0.965 to about 0.975.

The process, equipment and formulation disclosed herein provide an STY of at least about 20 g/L/h toner particles, at least about 30 g/L/h, at least about 40 g/L/hr, greater than about 100 g/L/h toner particles, greater than about 200 g/L/h toner particles, or more which is more than the current or conventional STY of about 9 g/L/h for batch processes, which is more than about a 5-fold increase, more than about a 10-fold increase, more than about a 20-fold increase or more than a batch process; accelerates the EA process so that material residence times are reduced from about 17 hours to about less than about 20 minutes, less than about 30 minutes, less than about 40 minutes; produces toner with up to about 25% less wax, up to about 40% less wax, up to about 60% less wax, up to about 80% less wax, up to about 100% less wax than found in conventional toner with higher amounts of wax made by a batch process, such as, about or more than about 8% wax, without any diminution of properties, such as, a fusing property; and reduces equipment size and other capital costs, operating costs and labor costs leading to lower toner cost. By, "up to about 25% less wax," is meant, using 8% as the amount of wax in a batch-produced toner, that a toner of interest comprises up to 6% wax, and so on for other amounts.

Of course, one skilled in the art may contemplate using a plurality of reactors in series configuration, where the size of the reactors is changed, where the temperature of each reactor is changed, and/or where the residence time is changed to achieve the results of the embodiments described herein as a design choice.

While the above description has identified specific components of a toner and materials utilized to form such toners, e.g., specific resins, colorants, waxes, surfactants, bases, buffers etc., it is understood that any component and/or material suitable for use in forming toner particles may be utilized with a system and process of the present disclosure as described herein. Exemplary components and materials that may be utilized to form toner particles with a system of the present disclosure are set forth below.

Resins

Any resin may be utilized in forming a latex emulsion of the present disclosure. In embodiments, the resins may be an amorphous resin, a crystalline resin and/or a combination thereof. The resin may be a polyester resin, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

The resin may be a polyester resin formed by reacting a diol with a diacid in the presence of an optional catalyst. For forming a crystalline polyester, suitable diols include aliphatic diols having from about 2 to about 36 carbon atoms, such as, 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like including their structural isomers. The aliphatic diol may be, for example, selected in an amount of from about 40 to about 60 mole percent, from about 42 to about 55 mole percent, from about 45 to about 53 mole percent, and a second diol optionally, can be selected in an amount of from about 0 to about 10 mole percent, from about 1 to about 4 mole percent of the resin.

Examples of diacids or diesters, including vinyl diacids or vinyl diesters selected for the preparing crystalline resins, include oxalic acid, succinic acid, glutaric acid, adipic acid, suberic acid, azelaic acid, sebacic acid, fumaric acid, dimethyl fumarate, dimethyl itaconate, cis 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The diacid may be used in an amount of from about 40 to about 60 mole percent, from about 42 to about 52 mole percent, from about 45 to about 50 mole percent, and a second diacid can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as polyethylene-adipate), poly(propylene-adipate), poly(butylene-adipate), poly(pentylene-adipate), poly (hexylene-adipate), poly(octylene-adipate), poly(ethylenesuccinate), poly(propylene-succinate), poly(butylene-succinate), poly(pentylene-succinate), poly(hexylene-succinate), poly(octylene-succinate), polyethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decano ate)-copoly(nonylene-decanoate), poly(octylene-adipate). Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyamides include poly(ethylene-adipimide), poly(propylene-adipimide), poly(butylene-adipimide), poly(pentylene-adipimide), poly(hexylene-adipimide), poly (octylene-adipimide), poly(ethylene-succinimide), poly(propylene-succinimide) and poly(butylene-succinimide).

The crystalline resin may be present, for example, in an amount of from about 1 to about 50 percent by weight of the toner components, from about 5 to about 35 percent by weight of the toner components. The crystalline resin can possess various melting points of, for example, from about 30° C. to about 120° C., from about 50° C. to about 90° C. The crystalline resin may have a number average molecular weight (Mn), as measured by gel permeation chromatography (GPC) of, for example, from about 1,000 to about 50,000, from about 2,000 to about 25,000, and a weight average molecular weight (Mw) of, for example, from about 2,000 to about 100,000, from about 3,000 to about 80,000, as determined by GPC. The molecular weight distribution (Mw/Mn) of the crystalline resin may be, for example, from about 2 to about 6, from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The diacids or diesters may be present, for example, in an amount from about 40 to about 60 mole percent of the resin, in embodiments, from about 42 to about 52 mole percent of the resin, from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic dials selected can vary, and may be present, for example, in an amount from about 40 to about 60 mole percent of the resin, from about 42 to about 55 mole percent of the resin, from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly (co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly (co-propoxylated bisphenol co-ethoxylated bisphenol co-itaconate), poly(1,2-propylene itaconate), and combinations thereof.

In embodiments, a suitable amorphous resin may include alkoxylated bisphenol A fumarate/terephthalate-based polyesters and copolyester resins. In embodiments, a suitable amorphous polyester resin may be a copoly(propoxylated bisphenol A co-fumarate)-copoly(propoxylated bisphenol A co-terephthalate) resin.

Suitable crystalline resins which may be utilized, optionally in combination with an amorphous resin as described above, include those disclosed in U.S. Publ. No. 2006/0222991, the disclosure of which is hereby incorporated by reference in entirety. In embodiments, a suitable crystalline resin may include a resin formed of ethylene glycol and a mixture of dodecanedioic acid and fumaric acid comonomers.

The amorphous resin may be present in an amount of from about 30 to about 90, from about 40 to about 80 percent by weight of the toner components. In embodiments, the amorphous resin or combination of amorphous resins utilized in the latex may have a glass transition temperature (Tg) of from about 30° C. to about 80° C., from about 35° C. to about 70° C. In embodiments, the combined resins utilized in the latex may have a melt viscosity of from about 10 to about 1,000,000 Pa*S at about 130° C., from about 50 to about 100,000 Pa*S.

One, two or more resins may be used. In embodiments, where two or more resins are used, the resins may be in any suitable ratio (e.g., weight ratio) for instance of from about 1% (first resin)/99% (second resin) to about 99% (first)/1% (second), from about 10% (first)/90% (second) to about 90% (first resin)/10% (second resin), where the resin includes an amorphous resin and a crystalline resin, the weight ratio of the two resins may be from about 99% (amorphous resin):1% (crystalline resin), to about 1% (amorphous resin):90% (crystalline resin).

In embodiments, when two amorphous polyester resins are utilized, one of the amorphous polyester resins may be of high molecular weight (HMW) and the second amorphous polyester resin may be of low molecular weight (LMW). As used herein, a high molecular weight amorphous resin may have, for example, an $M_w$ greater than about 55,000, for example, from about 55,000 to about 150,000, from about 50,000 to about 100,000, from about 60,000 to about 95,000, from about 70,000 to about 85,000, as determined by gel permeation chromatography (GPC).

An LMW amorphous polyester resin has, for example, an $M_w$ of 50,000 or less, for example, from about 2,000 to about 50,000, from about 3,000 to about 40,000, from about 10,000 to about 30,000, from about 15,000 to about 25,000, as determined by GPC using polystyrene standards. The LMW amorphous polyester resins, available from commercial sources, may have an acid value of from about 8 to about 20 mg KOH/grams, from about 9 to about 16 mg KOH/grams, from about 10 to about 14 mg KOH/grams. The LMW amorphous resins can possess an onset $T_g$ of, for example, from about 40° C. to about 80° C., from about 50° C. to about 70° C., from about 58° C. to about 62° C., as measured by, for example, differential scanning calorimetry (DSC).

In embodiments the resin may possess acid groups which, in embodiments, may be present at a terminus of a resin. Acid groups which may be present include carboxylic acid group and the like. The number of carboxylic acid groups may be controlled by adjusting the materials utilized to form the resin and reaction conditions.

In embodiments, the resin may be a polyester resin having an acid number from about 2 mg KOH/g of resin to about 200 mg KOH/g of resin, from about 5 mg KOH/g of resin to about 50 mg KOH/g of resin.

Other resins, such as, isoprenes, styrenes, acrylates and so on, as known in the art, can be used.

Surfactants

In embodiments, colorants, waxes, and other additives that may be utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two or more surfactants may be utilized. The surfactants may be selected from ionic surfactants and nonionic surfactants. Anionic surfactants and cationic surfactants are encompassed by the term, "ionic surfactants." In embodiments, the surfactant may be utilized so that it is present in an amount of from about 0.01% to about 5% by weight of the toner composition, from about 0.75% to about 4%, from about 1% to about 3% by weight of the toner composition.

Anionic surfactants which may be utilized include sulfates and sulfonates, sodium dodecylsulfate (SDS), sodium dodecylbenzene sulfonate, sodium dodecyinaphthalene sulfate, dialkyl benzenealkyl sulfates and sulfonates, acids such as abitic acid available from Aldrich, NEOGEN®, NEOGEN SC™ obtained from Daiichi Kogyo Seiyaku, combinations thereof and the like. Other suitable anionic surfactants include, in embodiments, DOWFAX™ 2A1, an alkyldiphenyloxide disulfonate from The Dow Chemical Co., and/or TAYCA POWER BN2060 from Tayca Corp. (JP), which are branched sodium dodecyl benzene sulfonates. Combinations of the surfactants and any of the foregoing anionic surfactants may be utilized in embodiments.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, mixtures thereof, and the like. In embodiments commercially available surfactants from Rhone-Poulenc such as IGEPAL CA-210™, IGEPAL CA-520™, IGEPAL CA720™, IGEPAL CO-890™, IGEPAL CO720™, IGEPAL CO290™, IGEPAL CA210™, ANTAROX 890™ and ANTAROX 897™ may be selected.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and $C_{12}$,$C_{15}$,$C_{17}$-trimethyl ammonium bromides, mixtures thereof and the like. Other cationic surfactants include cetyl pyridinium bromide, halide salts of quaternized polyoxyethylalkylamines, dodecylbenzyl triethyl ammonium chloride, and the like and mixtures thereof. The choice of particular surfactants or combinations thereof, as well as the amounts of each to be used, are within the purview of those skilled in the art.

Colorants

Various known dyes, pigments, mixtures of dyes, mixtures of pigments, mixtures of dyes and pigments and the like, may be included in the toner. The colorant may be included in the toner in an amount of, for example, about 0 to about 35 percent by weight of the toner, from about 1 to about 15 weight percent of the toner, from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP608™; Magnox magnetites TMB-100™ or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments can be used as water-based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Co., Inc., PIGMENT VIOLET 1™, PIGMENT RED 48™, LEMON CHROME YELLOW DCC 1026™, E.D. TOLUIDINE RED™ and BON RED C™ available from Dominion Color Corp., Ltd., Toronto, Calif., NOVAPERM YELLOW FGL™, HOSTAPERM PINK E™ from Hoechst, and CINQUASIA MAGENTA™ available from E.I. DuPont de Nemours & Co., and the like. Generally, colorants that can be selected are black, cyan, magenta, yellow and mixtures thereof. Examples of magentas are 2,9-dimethyl-substituted quinacridone and anthraquinone dye identified in the Color Index (CI) as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, copper phthalocyanine pigment listed as CI 74160, CI Pigment Blue (PB), PB 15:3 and Anthrathrene Blue, identified as CI 69810, Special Blue X-2137 and the like. Illustrative examples of yellows are diarylide yellow 3,3-dichlorobenzidene acetoacetanilides, a monoazo pigment identified as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Waxes

The toners of the present disclosure also can contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

Suitable waxes include, for example, submicron wax particles in the size range of from about 50 to about 500 nm, from about 100 to about 400 nm in volume average diameter, suspended in an aqueous phase of water and an ionic surfactant, nonionic surfactant or mixtures thereof. The ionic surfactant or nonionic surfactant may be present in an amount of from about 0.5 to about 10 percent by weight, from about 1 to about 5 percent by weight of the wax.

The wax dispersion includes, for example, natural vegetable wax, natural animal wax, mineral wax and/or synthetic wax. Examples of natural vegetable waxes include carnauba wax, candelilla wax, Japan wax and bayberry wax. Examples of natural animal waxes include beeswax, punic wax, lanolin, lac wax, shellac wax and spermaceti wax. Mineral waxes include, for example, paraffin wax, microcrystalline wax, montan wax, ozokerite wax, ceresin wax, petrolatum wax and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax and mixtures thereof.

Examples of polypropylene and polyethylene waxes include those commercially available from Allied Chemical and Baker Petrolite, wax emulsions available from Michelman Inc. and the Daniels Products Co., EPOLENE N-15 commercially available from Eastman Chemical Products, Inc., Viscol 550-P, a low weight average molecular weight polypropylene available from Sanyo Kasel K.K., and similar materials. In embodiments, commercially available polyethylene waxes possess an Mw of from about 1,000 to about 1,500, from about 1,250 to about 1,400, while the commercially available polypropylene waxes have a molecular weight of from about 4,000 to about 5,000, in embodiments, from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537 and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 0 to about 5% by weight, from about 1 to about 4% by weight of the toner, from about 2 to about 3% by weight of the toner. A toner of interest may comprise a wax at levels at least about 40% less, at least about 50% less, at least about 60% less, or less wax than found in conventional toner made by a batch process, which can be from about 8 to about 11% wax by toner weight, that is, about 8% or more, about 9% or more, about 10% or more, or more wax.

Basic Buffers

In embodiments, a buffer may include acids, salts, bases, organic compounds and combinations thereof in a solution with DIW as the solvent.

Suitable acids include, but are not limited to, organic and/or inorganic acids, such as, acetic acid, citric acid, hydrochloric acid, boric acid, formic acid, oxalic acid, phthalic acid, salicylic acid, combinations thereof and the like.

Suitable salts or bases include, but are not limited to, metallic salts of aliphatic acids or aromatic acids and bases, such as, NaOH, sodium tetraborate, potassium acetate, zinc acetate, sodium dihydrogen phosphate, disodium hydrogen phosphate, potassium formate, potassium hydroxide, sodium oxalate, sodium phthalate, potassium salicylate, combinations thereof and the like.

Suitable organic compounds include, but are not limited to, tris(hydroxymethyl)aminomethane (Tris), Tricine, Bicine, glycine, HEPES, triethanolamine hydrochloride, 3-(N-morpholino)propanesulfonic acid (MOPS), combinations thereof and the like.

In embodiments, a suitable buffer system may include a combination of acids and organic compounds, such as, Tris and hydrochloric acid.

The amount of acid and organic compound utilized in forming the buffer system, as well as DIW utilized in forming a buffer solution, may vary depending on the acid used, the organic compound used and the composition of the toner particles. As noted above, a buffer system may include both an acid and an organic compound. In such a case, the amount of acid in the buffer system may be from about 1% to about 40% by weight of the buffer system, from about 2% to about 30% by weight. The amount of organic compound in the buffer system may be from about 10% to about 50%, from about 30% to about 40% by weight of the buffer system.

The amount of acid and/or organic compound may be in amounts so that the pH of the buffer is from about 7 to about 12, from about 7 to about 9, from about 8 to about 9.

The buffer may be added to the toner slurry as described above so that the pH of the final toner slurry is from about 6 to about 9, from about 7 to about 8.

Acidic Buffers

Suitable acids include, but are not limited to, aliphatic acids and/or aromatic acids, such as, acetic acid, citric acid, formic acid, oxalic acid, phthalic acid, salicylic acid, combinations thereof and the like. Suitable salts which may be utilized to form the buffer system include, but are not limited to, metallic salts of aliphatic acids or aromatic acids, such as, sodium acetate, sodium acetate trihydrate, potassium acetate, zinc acetate, sodium hydrogen phosphate, potassium formate, sodium oxalate, sodium phthalate, potassium salicylate, combinations thereof and the like.

In embodiments, a suitable buffer system may include a combination of acids and salts, such as, sodium acetate and acetic acid.

In embodiments, a buffer may be in a solution with DIW as the solvent.

The amount of acid and salts utilized in forming the buffer system, as well as DIW in forming a buffer solution, may vary depending on the acid used, the salt used and the composition of the toner particles. A buffer system may include both an acid and a salt. In such a case, the amount of acid in the buffer system may be from about 1% by weight to about 40%, from about 2% by weight to about 30% by weight of the buffer system. The amount of salt in the buffer system may be from about 10% by weight to about 50% by weight of the buffer system, from about 30% by weight of the buffer system to about 40% by weight of the buffer system.

The amount of acid and/or salt in the buffer system may be in amounts so that the pH of the buffer system is from about 3 to about 7, from about 4 to about 6. The buffer system may be added to the toner slurry as described above so that the pH of the toner slurry is from about 4 to about 7, from about 5 to about 6.5.

For any coalescence processes, pH of the mixture can be lowered with, for example, an acid or acidic buffer. Suitable acids include nitric acid, sulfuric acid, hydrochloric acid, citric acid or acetic acid. The amount of acid added may be from about 4 to about 30%, from about 5 to about 15 percent by weight of the mixture.

After coalescence, the mixture may be cooled to room temperature (RT), such as, from about 20° C. to about 25° C. The cooling may be rapid or slow, as desired. A suitable cooling method may include introducing cold water to a jacket around the reactor or a heat exchanger. After cooling, the toner particles may be optionally washed with water and then dried. Drying may be accomplished by any suitable method for drying including, for example, freeze drying.

Coagulants

The emulsion aggregation process for making toners of the present disclosure can use at least a coagulant, such as, a monovalent metal coagulant, a divalent metal coagulant, a polyion coagulant or the like. As used herein, "polyion coagulant," refers to a coagulant that is a salt or oxide, such as, a metal salt or metal oxide, formed from a metal species having a valence of at least 3, at least 4, at least 5. Suitable coagulants include, for example, compounds comprising aluminum, such as, polyaluminum halides, such as, polyaluminum fluoride and polyaluminum chloride (PAC), polyaluminum silicates, such as, polyaluminum sulfosilicate (PASS), polyaluminum hydroxide, polyaluminum phosphate, aluminum sulfate and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin and the like. Where the coagulant is a polyion coagulant, the coagulants may have any desired number of polyion atoms present. For example, suitable polyaluminum compounds, in embodiments, have from about 2 to about 13, from about 3 to about 8, aluminum ions present in the compound Such coagulants can be incorporated into the toner particles during particle aggregation. As such, the coagulant can be present in the toner particles, exclusive of external additives, and on a dry weight basis, in amounts of from 0 to about 5 percent, from about greater than 0 to about 3 percent by weight of the toner particles.

Chelating Agents

In embodiments, a chelating agent may be added to the toner mixture during aggregation of the particles. Such chelating agents are described, for example, in U.S. Pat. No. 7,037,633, the disclosure of which hereby is incorporated by reference in entirety. Examples of suitable chelating agents include, but are not limited to, chelates based on ammonia, diamine, triamine or tetramine. In embodiments, suitable chelating agents include, for example, organic acids, such as, ethylene diamine tetra acetic acid (EDTA), GLDA (commercially available L-glutamic acid N,N diacetic acid), humic and fulvic acids, penta-acetic and tetra-acetic acids; salts of organic acids including salts of methylglycine diacetic acid (MGDA), esters of organic acids including potassium and sodium citrate, nitrotriacetate (NTA) salt; substituted pyranones including maltol and ethyl-maltol; water soluble polymers including polyelectrolytes comprising both carboxylic acid and hydroxyl functionalities; and combinations thereof.

The amount of sequestering agent added may be from about 0.25 parts per hundred (pph) to about 4 pph, from about 0.5 pph to about 2 pph. The chelating agent complexes or chelates with the coagulant metal ion, such as, aluminum, thereby extracting the metal ion from the toner aggregate particles. The resulting complex is removed from the particle to lower the amount of retained aluminum in the toner. The amount of metal ion extracted may be varied with the amount of sequestering agent, thereby providing controlled crosslinking and toner gloss. For example, adding about 0.5 pph of the sequestering agent by weight of toner, may extract from about 40 to about 60 percent of the aluminum ions, and the use of about 1 pph of the sequestering agent may result in the extraction of from about 95 to about 100 percent of the aluminum.

The toners may be blended at from about 1500 rpm to about 7000 rpm, from about 3000 revolutions per minute (rpm) to about 4500 rpm, for a period of time from about 2 minutes to about 30 minutes, from about 5 minutes to about 15 minutes, and at temperatures from about 20° C. to about 50° C., from about 22° C. to about 35° C.

Uses

Toner particles may have a size of about 1 μm to about 20 μm, from about 2 μm to about 15 μm, from about 3 μm to about 7 μm.

Toner in accordance with the present disclosure may be used in a variety of imaging devices including printers, copy machines and the like. The toners generated provide high quality colored images with excellent image resolution, acceptable signal-to-noise ratio and image uniformity.

Developer compositions may be prepared by mixing the toners obtained with the processes disclosed herein with known carrier particles, including coated carriers, such as, steel, ferrites and the like. Such carriers include those disclosed in U.S. Pat. Nos. 4,937,166 and 4,935,326, the disclosure of each of which hereby is incorporated by reference in entirety. The carriers may be present from about 2 percent by weight of the toner to about 8 percent by weight of the toner, from about 4 percent by weight to about 6 percent by weight of the toner. The carrier particles may also include a core with a polymer coating thereover, such as, polymethylmethacrylate (PMMA), having dispersed therein a conductive component like conductive carbon black. Carrier coatings include silicone resins, such as, methyl silsesquioxanes, fluoropolymers, such as, polyvinylidiene fluoride, mixtures of resins not in close proximity in the triboelectric series, such as, polyvinylidiene fluoride and acrylics, thermosetting resins, such as, acrylics, mixtures thereof and other known components.

Imaging methods are also envisioned with the toners disclosed herein. Such methods include, for example, some of the above patents mentioned above and U.S. Pat. Nos. 4,265,990, 4,858,884, 4,584,253 and 4,563,408, the disclosure of each of which hereby is incorporated by reference in entirety. The imaging process includes the generation of an image in an electronic printing magnetic image character recognition apparatus and thereafter developing the image with a toner composition of the present disclosure. The formation and development of images on the surface of photoconductive materials by electrostatic means is well known.

Toners of interest made by the processes and apparatus of interest can have an enhanced fusing property. A toner can have a wide fusing latitude. A toner can comprise reduced wax content without diminution of toner properties.

The following Examples illustrate embodiments of the instant disclosure. The Examples are intended to be illustrative only and are not intended to limit the scope of the present disclosure. Parts and percentages are by weight unless otherwise indicated. As used herein, "room temperature," (RT) refers to a temperature of from about 20° C. to about 30° C.

EXAMPLES

Example 1

A cyan feed polyester EA toner slurry was prepared in a 4 L glass kettle equipped with a large P4 and 2 fan impellers (486.0 g dry theoretical toner). The two amorphous emulsions, 340 g of LMW Resin 1 ($M_w$=19,400, $T_g$ onset=60° C.) and 371 g HMW Resin 2 ($M_w$=86,000, $T_g$ onset=56° C.), each containing 2% surfactant (Dowfax 2A1), 95 g crystalline emulsion ($M_w$=23,300, $M_n$=10,500, Tm=71° C.) containing 2% surfactant (Dowfax 2A1), 149 g wax (IGI, Toronto, Calif.), 1844 g of DI water and 171 g cyan pigment (PB 15:3 dispersion) are mixed in the kettle, then pH adjusted to 4.2 using 0.3M nitric acid. The slurry then is homogenized for a total of 5 minutes at 3000-4000 rpm while adding coagulant consisting of 8.7 g aluminum sulphate mixed with 100 g DI water. The slurry is set mixing at 340 rpm and heated to a batch temperature of 46° C. During aggregation, a shell comprised of the same amorphous emulsions as in the core (188 g of Resin 1 and 205 g of Resin 2, both containing 2% Dowfax2A1) is pH adjusted to 3.3 with nitric acid and was added to the batch. Then the batch mixing is increased to 380 rpm to achieve the targeted particle size. Once at the target particle size, a pH adjustment is made to 7.8 using sodium hydroxide (NaOH) and EDTA to freeze the aggregation process.

The feed slurry is held at those conditions (temperature 46° C., 160 rpm, pH 7.8) for the entire succeeding continuous experiment. At the outset, the particles had a D50 of 5.654, GSDv of 1.201 and GSDn of 1.22. The feed slurry was then pumped into the ramp and coalescence reactor continuously at 40 g/min. As the slurry traveled through a single section of the continuous reactor, the slurry was heated to 85° C. and exited the continuous reactor after spending a total residence time of 5.1 minutes in the reactor. pH of the slurry in the reactor was adjusted to 6.0 through the addition of an acetic acid/sodium acetate buffer pumped in continuously at a rate of 1.1 g/min. The temperature and pH promoted the spherodization of the toner particles. Particle size traces of the exited particles were essentially unchanged by passage through the continuous reactor. The toner exiting the reactor had a circularity of 0.975 which was higher than necessary to meet specifications (e.g., ≥0.950).

Example 2

The reagents of Example 1 were used except that the entire process was continuous where the toner reagents were mixed at 5° C. and introduced into a 200 ml continuous reactor for aggregation and coalescence. After introduction of the slurry into the reactor, the slurry temperature was increased to 35° C. to enable particle growth. Shell resin was added to the slurry via an injection port and the temperature of the slurry was increased to 40° C. The pH of the slurry was maintained at about 3. When the desired particle size was achieved, the temperature of the slurry was increased to 45° C. and the pH was increased to about 7.8 with NaOH and EDTA. Then, the pH of the slurry was adjusted to about 6.3 with a sodium acetate/acetic acid buffer and the temperature was increased to 85° C. The total residence time in the reactor was 35 min.

Example 3

The toner of Example 2 was compared to a toner made with the same reagents but produced solely by batch processing in 2 liter reactors. Fusing gloss curves as a function of fuser temperature revealed that the toner of Example 2 has wider fusing latitude and a flatter gloss curve profile than the batch toner made at a similar scale at the bench (FIG. 1). The improvement in fusing latitude is greater than 20° C. with no observed hot offset.

Example 4

The same reagents and method of Example 1 were practiced except the amount of wax was reduced by 50% to 75 grams wax (IGI, Toronto, Calif.).

The toner exiting the reactor had a circularity of 0.950, comparable to that of a commercial batch toner. Particle size and distribution were substantially the same as that observed for a toner produced by batch. The continuous toner was compared to that commercial batch toner for gloss and crease area in relation to fusing temperature. Performance of the two toners was substantially the same, even though the continuous toner contained half the amount of wax as the control batch toner.

Because of the wider fusing latitudes of toners produced by a continuous reactor, a new class of low wax toners was developed. Hence, toners can be designed with from about 3 to about 5% wax content with wider fusing latitude than toners produced at a similar bench scale in batch format with from about 8 to about 10% wax and comparable to fusing latitudes of production scale toners that contain from about 8 to about 10% wax. Despite the low wax content of the new toner, the fusing latitude is comparable to or better than that of conventional batch toner containing twice as much wax.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

We claim herein:

1. A process for the production of toner particles by emulsion aggregation, comprising:

a. continuously or semi-continuously feeding latex materials in a slurry to form particles in a reactor system comprising:

at least one reactor for facilitating an aggregation process; and at least one reactor for facilitating temperature ramp-up and coalescence processes, wherein the latex materials are selected from the group consisting of a latex resin, an optional pigment, an optional wax, an optional flocculent and combinations thereof, b. aggregating said particles in said slurry;

c. adding a shell latex resin in a first separate contiguous reactor section and heating said section from about 35° C. to about 45° C.;

d. adding a chelator in a second separate contiguous reactor section and adjusting pH in said section from about 7 to about 8.5;

e. ramping up the temperature of said slurry comprising aggregated particles;

f. adding one or more buffers in a third separate contiguous reactor section and heating said section from about 80° C. to about 90° C., and g. coalescing the aggregated particles to produce toner particles, wherein the resulting toner particles comprise an enhanced fusing property as compared to toner particles made by a batch method and wherein the temperature of each of the reactor sections is modulated by externally applied cooling or heating.

2. The process of claim 1, comprising semi-continuous feeding, of latex materials, wherein aggregating and coalescing are carried out in discontinuous reactors in fluid communication.

3. The process of claim 1, further comprising freezing growth of said aggregated particles prior to continuous feeding into the at least one reactor for facilitating temperature ramp-up and coalescence processes.

4. The process of claim 3, wherein freezing occurs by exposing said aggregated particles in said slurry to base, buffer, chelator or combinations thereof.

5. The process of claim 4, wherein pH of said slurry is from about 7 to about 8.5.

6. The process of claim 3, wherein freezing occurs at a temperature from about 40° C. to about 50° C.

7. The process of claim 1, further comprising adding said optional shell latex resin to said at least one reactor for facilitating an aggregation process.

8. The process of claim 1, wherein coalescing occurs at a temperature of about 80° C. to about 90° C.

9. The process of claim 1, wherein the process produces toner particles with a space time yield (STY) of greater than about 20 g/L/hr, at a rate of at least about 10 g/min, or both.

10. The process of claim 1, comprising continuously feeding latex materials in a slurry to produce particles, wherein aggregating, ramping, and coalescing are carried out in a continuous reactor.

11. The process of claim 10, comprising a residence time of less than about 40 minutes.

12. The process of claim 1, wherein a residence time of the latex materials in the at least one reactor for facilitating temperature ramp-up and coalescence processes is from about 5 minutes to about 15 minutes.

13. The process of claim 1, wherein coalescence is stopped by raising the pH, lowering the temperature or both.

14. The process of claim 1, wherein aggregation occurs at a temperature from about 30° C. to about 45° C.

15. The process of claim 1, wherein said toner has a circularity of from about 0.95 to about 0.985.

16. The process of claim 1, comprising a wax in an amount from about 0 to about 5% by weight and wherein said toner particle made by a batch method comprises about 8% or more wax.

17. The process of claim 1, further comprising heating the latex materials traveling along contiguous sections of the reactor comprising:

heating said first separate contiguous reactor section from about 37° C. to about 43° C.; and heating said second separate contiguous reactor section from about 40° C. to about 50° C.

18. The process of claim 1, wherein a wax is present in an amount up to about 100% less wax than found in conventional toner comprising at least about 8% or more wax.

* * * * *